US009152117B2

(12) United States Patent
Takeuchi et al.

(10) Patent No.: US 9,152,117 B2
(45) Date of Patent: Oct. 6, 2015

(54) IMAGE FORMING APPARATUS AND TONER CONTAINER ORDERING METHOD

(71) Applicant: KYOCERA Document Solutions Inc.

(72) Inventors: Naoki Takeuchi, Osaka (JP); Masato Hirota, Osaka (JP)

(73) Assignee: Kyocera Document Solutions Inc. (JP)

( * ) Notice: Subject to any disclaimer, the term of this patent is extended or adjusted under 35 U.S.C. 154(b) by 20 days.

(21) Appl. No.: 14/096,360

(22) Filed: Dec. 4, 2013

(65) Prior Publication Data

US 2014/0169809 A1 Jun. 19, 2014

(30) Foreign Application Priority Data

Dec. 13, 2012 (JP) ..... 2012-272856

(51) Int. Cl.

| | |
|---|---|
| ***G03G 15/00*** | (2006.01) |
| ***G03G 21/00*** | (2006.01) |
| ***G03G 21/18*** | (2006.01) |
| ***G03G 15/08*** | (2006.01) |

(52) U.S. Cl.

CPC ..... *G03G 15/556* (2013.01); *G03G 15/0856* (2013.01); *G03G 15/5083* (2013.01); *G03G 21/1875* (2013.01)

(58) Field of Classification Search

CPC ..... G03G 15/0831; G03G 15/0856; G03G 15/0863; G03G 15/5083; G03G 15/556; G03G 21/1875

USPC ..... 399/27, 24

See application file for complete search history.

(56) References Cited

U.S. PATENT DOCUMENTS

| | | | | |
|---|---|---|---|---|
| 2003/0035656 | A1 * | 2/2003 | Yamamoto et al. | 399/27 |
| 2003/0040984 | A1 | 2/2003 | Inami et al. | |
| 2004/0158632 | A1 | 8/2004 | Sasaki | |
| 2013/0272726 | A1 * | 10/2013 | Sunahara | 399/27 X |

FOREIGN PATENT DOCUMENTS

| | | | |
|---|---|---|---|
| JP | 2003-063104 A | * | 3/2003 |
| JP | 2003-076754 | | 3/2003 |
| JP | 2004-054112 | | 2/2004 |
| JP | 2004-234639 | | 8/2004 |

* cited by examiner

*Primary Examiner* — Sophia S Chen

(57) ABSTRACT

A toner consumption amount identifying unit identifies a toner consumption amount of toner consumed in a printing process from the print data. A toner residual amount identifying unit identifies a toner residual amount in a toner container from the toner consumption amount. A toner residual amount data managing unit stores order-timing toner residual amount data into a non volatile memory device at a timing when an ordering process of the toner container succeeds, and deletes the order-timing toner residual amount data in the non volatile memory device if the value of the toner residual amount is larger than a value of the order-timing toner residual amount data. An order processing unit performs the ordering process if the order-timing toner residual amount data is not stored in the non volatile memory device and the value of the toner residual amount is either equal to or less than a predetermined value.

5 Claims, 3 Drawing Sheets

IMAGE FORMING APPARATUS AND TONER CONTAINER ORDERING METHOD

CROSS-REFERENCE TO RELATED APPLICATIONS

This application relates to and claims priority rights from Japanese Patent Application No. 2012-272856, filed on Dec. 13, 2012, the entire disclosures of which are hereby incorporated by reference herein.

BACKGROUND

1. Field of Present Disclosure

The present disclosure relates to an image forming apparatus and a toner container ordering method.

2. Description of the Related Art

In an image forming apparatus, a development is performed with toner provided from a toner container for printing. In an image forming apparatus, a toner residual amount in a toner container is estimated from an output of a physical sensor, and if the toner residual amount reaches a predetermined value or less, then a near empty status of the toner residual amount is informed and an order of a toner container is placed.

When the toner residual amount is estimated from an output of a physical sensor as mentioned, an estimation error at a low toner residual amount is large due to uneven distribution of toner in a toner container and so forth.

Usually, when the near empty status is informed, a user prepares a new toner container. However, when the near empty status is informed of a toner container, in order to fully use residual toner, some users detach and shake the toner container, and then reattach the toner container to the apparatus. This operation may cancel the uneven distribution of toner in the toner container and consequently may increase the toner residual amount value estimated from the sensor output and may temporarily cancel the near empty status. In such a case, the near empty status is detected afterward, the near empty status is informed again.

Therefore, if at the near empty status the toner container is detached and reattached, then the near empty status is detected plural times, and consequently for one toner container, plural orders of toner containers are redundantly placed.

SUMMARY

An image forming apparatus according to an aspect of the present disclosure includes a non volatile memory device; a toner consumption amount identifying unit configured to identify from print data a toner consumption amount of toner consumed in a printing process based on the print data; a toner residual amount identifying unit configured to identify a toner residual amount in a toner container from the toner consumption amount identified from the print data; a toner residual amount data managing unit configured (a) to store a value of the toner residual amount at a timing when an ordering process of the toner container succeeds as order-timing toner residual amount data into the non volatile memory device, and (b) to delete the order-timing toner residual amount data in the non volatile memory device if the value of the toner residual amount identified by the toner residual amount identifying unit is larger than a value of the order-timing toner residual amount data; and an order processing unit configured to perform an ordering process of the toner container if the order-timing toner residual amount data is not stored in the non volatile memory device and the value of the toner residual amount identified by the toner residual amount identifying unit is either equal to or less than a predetermined value.

A toner container ordering method includes the steps of: identifying from print data a toner consumption amount of toner consumed in a printing process based on the print data; identifying a toner residual amount in a toner container from the toner consumption amount identified from the print data; storing a value of the toner residual amount if an ordering process of the toner container succeeds as order-timing toner residual amount data into a non volatile memory device; deleting the order-timing toner residual amount data in the non volatile memory device if the value of the identified toner residual amount is larger than a value of the order-timing toner residual amount data; and performing an ordering process of the toner container if the order-timing toner residual amount data is not stored in the non volatile memory device and the value of the identified toner residual amount is either equal to or less than a predetermined value.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
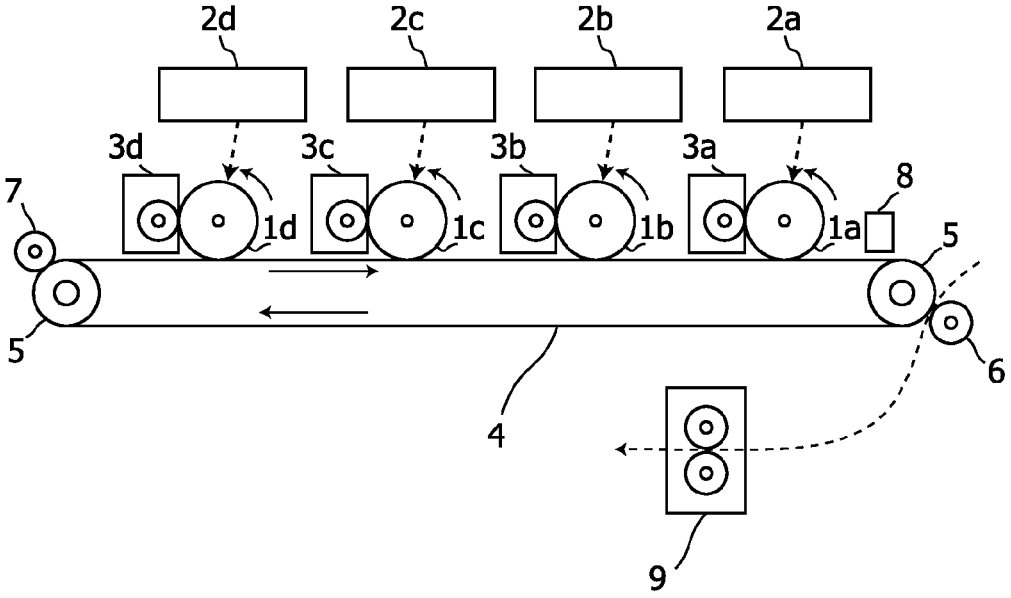
FIG. 1 is a side view that shows an internal mechanical configuration of an image forming apparatus in an embodiment according to the present disclosure.

FIG. 1 is a side view that shows an internal mechanical configuration of an image forming apparatus in an embodiment according to the present disclosure. This image forming apparatus is an image forming apparatus having a printing function, such as printer, facsimile machine, copier, or multi function peripheral.

The image forming apparatus in this embodiment has a tandem-type color development device. This color development device has photoconductor drums 1*a* to 1*d*, exposure devices 2*a* to 2*d*, and development devices 3*a* to 3*d*. The photoconductor drums 1*a* to 1*d* are four color photoconductors of Cyan, Magenta, Yellow and Black. The exposure devices 2*a* to 2*d* are devices that form electrostatic latent images by irradiating laser light to the photoconductor drums 1*a* to 1*d*. The exposure devices 2*a* to 2*d* have laser diodes as light sources of the laser light, optical elements (such as lens, mirror and polygon mirror) that guide the laser light to the respective photoconductor drums 1*a* to 1*d*.

Further, in the periphery of the photoconductor drums 1*a* to 1*d*, a charging unit such as scorotron, a cleaning device, a static electricity eliminator and so on are disposed. The cleaning device removes residual toner on the photoconductor drums 1*a* to 1*d* after primary transfer. The static electricity eliminator eliminates static electricity of the photoconductor drums after primary transfer.

Toner containers which contain toner of four colors: Cyan, Magenta, Yellow and Black are attached to the development devices 3*a* to 3*d*, respectively. In the development devices 3*a* to 3*d*, the toner is supplied from the toner containers and this toner and carrier compose developer. The development devices 3*a* to 3*d* form toner images by attaching the toner to electrostatic latent images on the photoconductor drums 1*a* to 1*d*. The toner containers can be detached and attached and are replaced by a service person or a user.

The photoconductor drum 1*a*, the exposure device 2*a* and the development device 3*a* perform development of Magenta. The photoconductor drum 1*b*, the exposure device 2*b* and the development device 3*b* perform development of Cyan. The photoconductor drum 1*c*, the exposure device 2*c* and the development device 3*c* perform development of Yellow. The photoconductor drum 1*d*, the exposure device 2*d* and the development device 3*d* perform development of Black.

The intermediate transfer belt 4 is a loop-shaped image carrier, and contacts the photoconductor drums 1*a* to 1*d*. Toner images on the photoconductor drums 1*a* to 1*d* are primarily transferred onto the intermediate transfer belt 4. The intermediate transfer belt 4 is hitched round driving rollers 5, and rotates by driving force of the driving rollers 5 towards the direction from the contact position with the photoconductor drum 1*d* to the contact position with the photoconductor drum 1*a*.

A transfer roller 6 makes a conveyed paper sheet contact the transfer belt 4, and secondarily transfers the toner image on the transfer belt 4 to the paper sheet. The paper sheet on which the toner image has been transferred is conveyed to a fuser 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet.

A sensor 8 is a sensor used to toner density adjustment, and irradiates the intermediate transfer belt 4 with a light beam and detects its reflection light.

Figure 2:
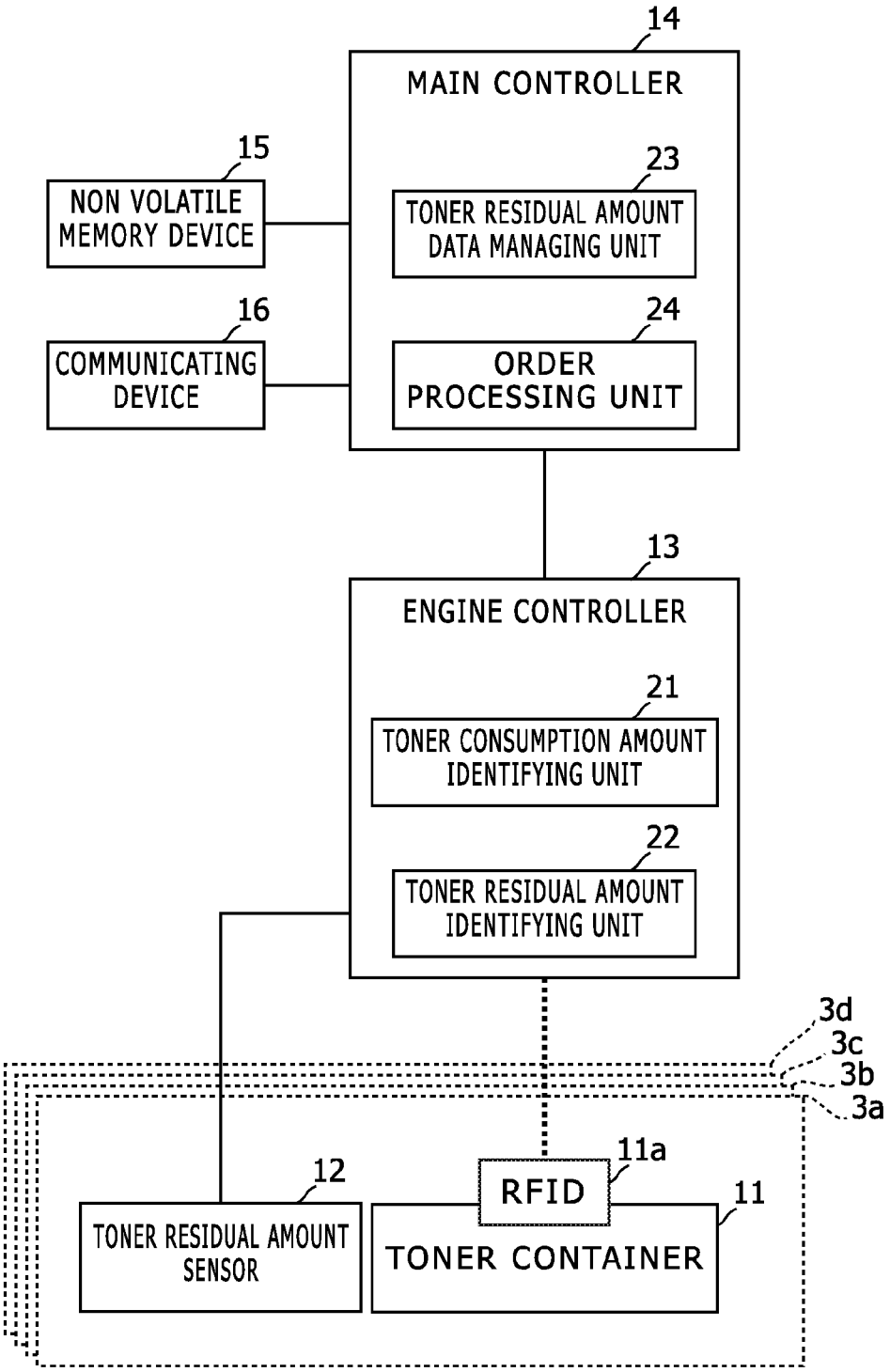
FIG. 2 is a block diagram that shows an electronic configuration of the image forming apparatus in the embodiment according to the present disclosure.

FIG. 2 is a block diagram that shows an electronic configuration of the image forming apparatus in the embodiment according to the present disclosure.

As shown in FIG. 2, toner containers 11 filled up with toner of respective toner colors are attached to the respective development devices 3*a* to 3*d*. An RFID (Radio Frequency IDentification) 11*a* is arranged and fixed to the toner container 11. The RFID 11*a* includes a built-in non volatile memory in which information on this toner container 11 is stored. For example, the image forming apparatus writes information such as a toner color, a toner consumption amount and so forth of this toner container 11 in this RFID 11*a*.

Further, the development device 3*a* to 3*d* are equipped with toner residual amount sensors 12 that estimate toner residual amount statuses (a near empty status, an empty status and so forth) of the respective toner containers 11. The toner residual amount sensors 12 output respective electronic signals corresponding to toner amounts supplied from the toner containers 11 to the development devices 3*a* to 3*d*. An engine controller 13 detects the near empty status, the empty status and so forth on the basis of the output signals from the toner residual amount sensors 12. As the toner residual sensors 12, piezoelectric sensors, optical sensors, or the like are used.

Further, this image forming apparatus includes the engine controller 13, a main controller 14, a non volatile memory device 15, and a communicating device 16. For example, the engine controller 13 and the main controller 14 are ASICs (Application Specific Integrated Circuits), the non volatile memory device 15 is a flash memory, the communicating device 16 is a network interface or a modem capable of network communication.

The engine controller 13 receives print data (here, CMYK image data after a screen process), and performs printing by controlling internal devices on the basis of the print data. The engine controller 13 controls a driving source that drives the aforementioned rollers, a bias induction circuit that induces a development bias and a primary transfer bias, and the exposure devices 2*a* to 2*d* in order to perform forming an electrostatic latent image, developing a toner image, transferring and fixing the toner image, feeding a sheet of paper, printing on the sheet, and outputting the sheet.

Further, the engine controller 13 includes a toner consumption amount identifying unit 21 and a toner residual amount identifying unit 22.

The toner consumption amount identifying unit 21 identifies from print data a toner consumption amount of toner consumed in a printing process based on the print data. Specifically, the toner consumption amount identifying unit 21 counts the number of toner dots caused by the print data, and identifies the toner consumption amount on the basis of a count value of the number of the dots. The toner consumption amount identifying unit 21 identifies respective toner consumption amounts of toner colors (CMYK).

Further, the toner consumption amount identifying unit 21 renews toner consumption amount data in the RFID 11*a* on the basis of a toner consumption amount of toner consumed in a printing process based on the print data. For example, each time when a print process of one print job is completed, the toner consumption amount identifying unit 21 calculates a toner consumption amount at the completion timing of the print job (i.e. a dot count number from the beginning of use of the toner container 11), and renews toner consumption amount data in the RFID 11*a* with a value of the toner consumption amount.

The toner residual amount identifying unit 22 identifies a toner residual amount in a toner container from the toner consumption amount identified from the print data. Thus, the toner residual amount identifying unit 22 identifies the toner residual amount without using outputs of the toner residual amount sensors 12.

Further, when detecting either detaching and attaching the toner container 11 or opening and shutting of a cover (not shown) that is necessary to detaching and attaching the toner container 11, the toner residual amount identifying unit 22 reads the toner consumption amount data in the RFID 11*a*, and identifies the toner residual amount in the toner container 11 from a value of the read toner consumption amount data and the toner consumption amount identified from the print data after its timing.

Thus, the sum of the value of the read toner consumption amount data and the toner consumption amount identified from the print data is identified as the total toner consumption amount from the beginning of use of the toner container 11.

The main controller 14 receives a job such as printing or copying, performs a print job using the engine controller 13 and so forth, and watches internal devices.

Further, the main controller 14 includes a toner residual amount data managing unit 23 and an order processing unit 24.

The toner residual amount data managing unit 23 stores a value of the toner residual amount at a timing when the order processing unit 24 successfully performs an ordering process for a new toner container as order-timing toner residual amount data into the non volatile memory device 15, and deletes the order-timing toner residual amount data in the non volatile memory device 15 if the value of the toner residual amount identified by the toner residual amount identifying unit 22 is larger than a value of the order-timing toner residual amount data.

The toner residual amount data managing unit 23 does not store the order-timing toner residual amount data into the non volatile memory device 15 if the ordering process does not succeed. Further, the toner residual amount data managing unit 23 does not delete the order-timing toner residual amount data in the non volatile memory device 15 if the value of the toner residual amount identified by the toner residual amount identifying unit 22 is either equal to or less than a value of the order-timing toner residual amount data.

The order processing unit 24 performs an ordering process of a toner container if the order-timing toner residual amount data is not stored in the non volatile memory device 15 and the value of the toner residual amount identified by the toner residual amount identifying unit 22 is either equal to or less than a predetermined value (e.g. 5 percents). Thus, the order processing unit 24 determines a timing of the ordering process of a toner container without consideration to output values of the toner residual amount sensors 12. Specifically, the order processing unit 24 performs communication with an unshown order management server on a network using the communicating device 16, and places an order of a toner container to the order management server; and determines that the ordering process succeeded if the order processing unit 24 receives a response as an ordering receipt from the order management server.

Further, each time when the toner residual amount identified by the toner residual amount identifying unit 22 is changed by a predetermined amount (e.g. 1 percent), the order processing unit 24 identifies whether or not (a) the order-timing toner residual amount data is not stored in the non volatile memory device 15 and (b) the value of the toner residual amount identified by the toner residual amount identifying unit 22 is either equal to or less than a predetermined value.

In the following part, a behavior of the aforementioned image forming apparatus is explained.

Figure 3:
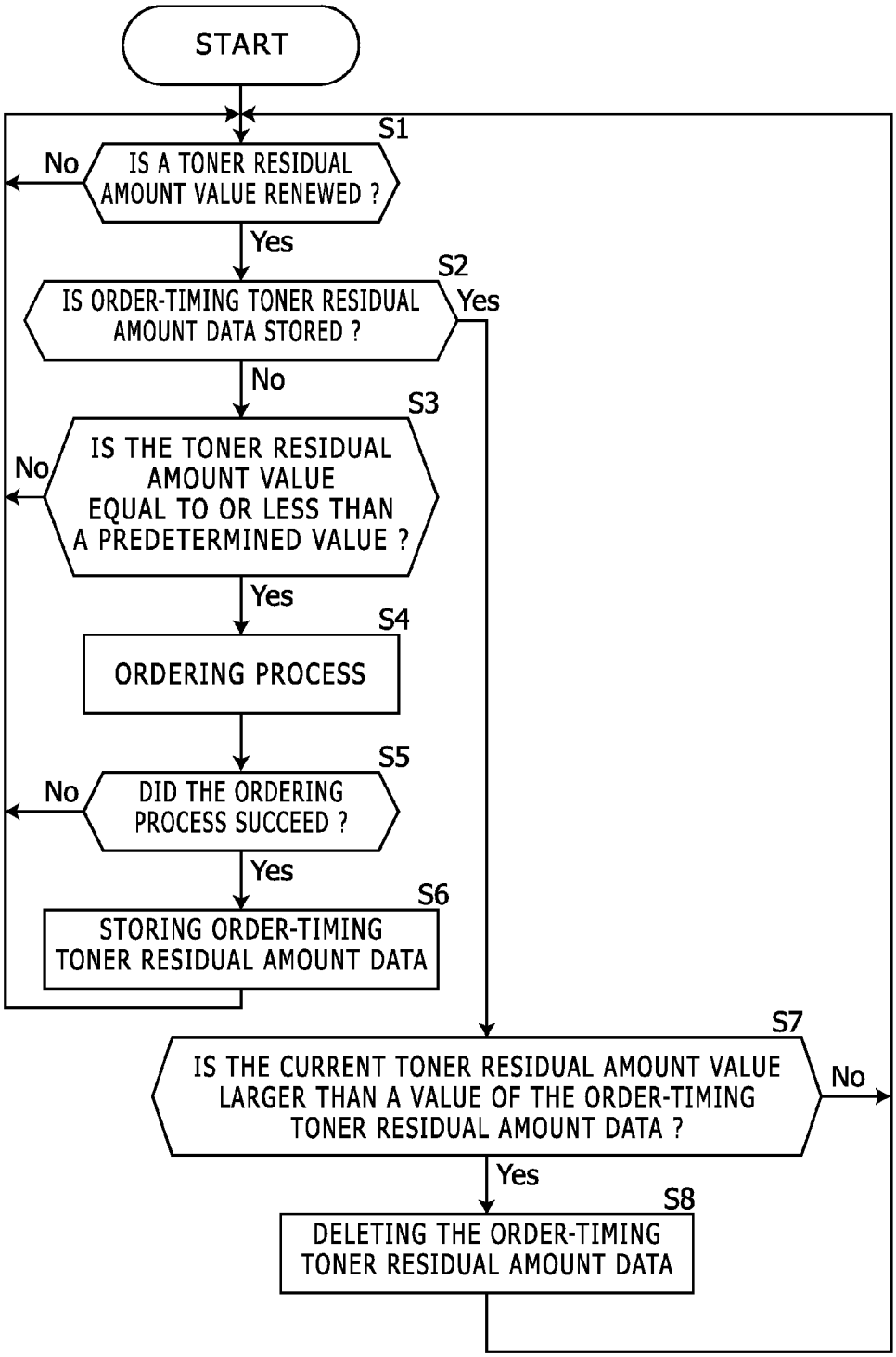
FIG. 3 is a flowchart that explains a behavior of a main controller in FIG. 2.

FIG. 3 is a flowchart that explains a behavior of the main controller 14 in FIG. 2.

In the engine controller 13, the toner consumption amount identifying unit 21 identifies a toner consumption amount of each one of the toner containers 11 each time when printing an image is performed, and the toner residual amount identifying unit 22 identifies a toner residual amount (any in a range from 0 percent to 100 percents) corresponding to this toner consumption amount, and outputs a toner residual amount notice to the main controller 14 each time when the toner residual amount decreases by 1 percent.

In the main controller 14, when the order processing unit 24 receives the toner residual amount notice of one of the toner containers 11 (Step S1), and identifies whether or not the order-timing toner residual amount data of this toner container 11 (i.e. of its toner color) is stored in the non volatile memory device 15 (Step S2).

If the order-timing toner residual amount data of this toner container 11 (i.e. of its toner color) is not stored in the non volatile memory device 15, the order processing unit 24 identifies whether or not the value of the toner residual amount informed by the toner residual amount notice is either equal to or less than a predetermined value (Step S3).

If the value of the toner residual amount informed by the toner residual amount notice is either equal to or less than the predetermined value, then the order processing unit 24 performs an ordering process of this toner container 11 (i.e. of its toner color) (Step S4). If the value of the toner residual amount informed by the toner residual amount notice is neither equal to nor less than the predetermined value, then the ordering process is not performed.

Subsequently, the toner residual amount data managing unit 23 identifies whether or not the ordering process by the order processing unit 24 succeeded (Step S5). If the ordering process by the order processing unit 24 succeeded, then the toner residual amount data managing unit 23 stores order-timing toner residual amount data into the non volatile memory device 15 (Step S6). This order-timing toner residual amount data has a toner residual amount value informed by this toner residual amount notice.

Otherwise, if the ordering process by the order processing unit 24 did not succeed, then the toner residual amount data managing unit 23 does not store the order-timing toner residual amount data into the non volatile memory device 15.

In Step S2, if the order-timing toner residual amount data of this toner container 11 (i.e. of its toner color) is stored in the non volatile memory device 15, the order processing unit 24 does not perform the ordering process regardless of the value of the toner residual amount value informed by this toner residual amount notice.

Further, if the order-timing toner residual amount data of this toner container 11 (i.e. of its toner color) is stored in the non volatile memory device 15 when the toner residual amount notice is received, then the toner residual amount data managing unit 23 identifies whether or not the value of the toner residual amount value informed by this toner residual amount notice is larger than a value of the order-timing toner residual amount data stored in the non volatile memory device 15 (Step S7).

If the value of the toner residual amount value informed by this toner residual amount notice is larger than a value of the order-timing toner residual amount data stored in the non volatile memory device 15, then the toner residual amount data managing unit 23 deletes the order-timing toner residual amount data in the non volatile memory device 15 (Step S8).

The condition that the value of the toner residual amount value informed by this toner residual amount notice is larger than a value of the order-timing toner residual amount data stored in the non volatile memory device 15 means that the toner container 11 was replaced, and therefore, the order-timing toner residual amount data for the toner container 11 before replacement is deleted. Consequently, one ordering process for one toner container 11 is guaranteed.

Further, if the value of the toner residual amount value informed by this toner residual amount notice is either equal to or less than a value of the order-timing toner residual amount data stored in the non volatile memory device 15, then the toner residual amount data managing unit 23 does not delete the order-timing toner residual amount data in the non volatile memory device 15.

In the aforementioned embodiment, the toner consumption amount identifying unit 21 identifies from print data a toner consumption amount of toner consumed in a printing process based on the print data, and the toner residual amount identifying unit 22 identifies a toner residual amount in a toner container from the toner consumption amount identified from the print data. The toner residual amount data managing unit 23 stores a value of the toner residual amount at a timing when the order processing unit 24 successfully performs an ordering process for a new toner container as order-timing toner residual amount data into the non volatile memory device 15, and deletes the order-timing toner residual amount data in the non volatile memory device 15 if the value of the toner residual amount identified by the toner residual amount identifying unit 22 is larger than a value of the order-timing toner residual amount data. The order processing unit 24 performs an ordering process of a toner container if the order-timing toner residual amount data is not stored in the non volatile memory device 15 and the value of the toner residual amount identified by the toner residual amount identifying unit 22 is either equal to or less than a predetermined value.

Therefore, even if a user detaches the toner container 11 at the near empty status and reattaches it, the toner residual amount identified by the toner residual amount identifying unit 22 does not increase; and therefore, the ordering process is performed only once until the toner container 11 is replaced. Consequently, a redundant order of a toner container is prevented.

The description has been presented for purposes of illustration and description, and is not intended to be exhaustive or limited to the present disclosure.

For example, while the image forming apparatus in the aforementioned embodiment is a color image forming apparatus, the feature of the present disclosure can also be applied to a monochrome image forming apparatus. Further, while the image forming apparatus of the aforementioned embodiment is an indirect-transfer image forming apparatus (i.e. having an intermediate transfer member), the feature of the present disclosure can also be applied to a direct-transfer image forming apparatus.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

What is claimed is:

1. An image forming apparatus, comprising:

a non volatile memory device;

a toner consumption amount identifying unit configured to identify from print data a toner consumption amount of toner consumed in a printing process based on the print data;

a toner residual amount identifying unit configured to identify a toner residual amount in a toner container from the toner consumption amount identified from the print data;

a toner residual amount data managing unit configured (a) to store a value of the toner residual amount at a timing when an ordering process of the toner container succeeds as order-timing toner residual amount data into the non volatile memory device, and (b) to delete the order-timing toner residual amount data in the non volatile memory device if the value of the toner residual amount identified by the toner residual amount identifying unit is larger than a value of the order-timing toner residual amount data; the value of the toner residual amount being larger than a value of the order-timing toner residual amount when the toner container is replaced with a new container; and an order processing unit configured to perform an ordering process of the toner container if the order-timing toner residual amount data is not stored in the non volatile memory device and the value of the toner residual amount identified by the toner residual amount identifying unit is either equal to or less than a predetermined value.

2. The image forming apparatus according to claim 1, wherein the order processing unit is further configured to identify whether or not the order-timing toner residual amount data is not stored in the non volatile memory device and the value of the toner residual amount identified by the toner residual amount identifying unit is either equal to or less than a predetermined value each time when the toner residual amount identified by the toner residual amount identifying unit is changed by a predetermined amount.

3. The image forming apparatus according to claim 1, wherein the toner container includes a container memory device that stores toner consumption amount data that indicates a toner consumption amount of this toner container;

the toner consumption amount identifying unit is further configured to renew the toner consumption amount data in the container memory device on the basis of a toner consumption amount of toner consumed in a printing process based on the print data; and the toner residual amount identifying unit is further configured (a) to read the toner consumption amount data in the container memory device when detecting either detaching and attaching the toner container or opening and shutting of a cover that is necessary to detaching and attaching the toner container and (b) to identify the toner residual amount in the toner container from a value of the read toner consumption amount data and the toner consumption amount identified from the print data.

4. The image forming apparatus according to claim 1, wherein the toner residual amount data managing unit is further configured (a) not to store the order-timing toner residual amount data into the non volatile memory device if an ordering process of the toner container does not succeed and (b) not to delete the order-timing toner residual amount data in the non volatile memory device if the value of the toner residual amount identified by the toner residual amount identifying unit is either equal to or less than a value of the order-timing toner residual amount data.

5. A toner container ordering method, comprising the steps of:

identifying from print data a toner consumption amount of toner consumed in a printing process based on the print data;

identifying a toner residual amount in a toner container from the toner consumption amount identified from the print data;

storing a value of the toner residual amount at a timing when an ordering process of the toner container succeeds as order-timing toner residual amount data into a non volatile memory device;

deleting the order-timing toner residual amount data in the non volatile memory device if the value of the identified toner residual amount is larger than a value of the order-timing toner residual amount data; the value of the toner residual amount being larger than a value of the order-timing toner residual amount when the toner container is replaced with a new container and performing an ordering process of the toner container if the order-timing toner residual amount data is not stored in the non volatile memory device and the value of the identified toner residual amount is either equal to or less than a predetermined value.

* * * * *